US007950969B1

(12) United States Patent
Savant

(10) Patent No.: US 7,950,969 B1
(45) Date of Patent: May 31, 2011

(54) ONE-PIECE TERMINAL BLOCK ASSEMBLY

(75) Inventor: Satish D. Savant, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/624,744

(22) Filed: Nov. 24, 2009

(51) Int. Cl.
*H01R 9/22* (2006.01)

(52) U.S. Cl. ..... 439/722

(58) Field of Classification Search ..... 439/721–725, 439/709, 727, 797, 798
See application file for complete search history.

(56) References Cited

U.S. PATENT DOCUMENTS

| | | | | |
|---|---|---|---|---|
| 1,550,450 | A | 8/1925 | Orr | |
| 2,549,725 | A | 4/1951 | Uline et al. | |
| 2,923,913 | A | 2/1960 | Kulka | |
| 2,983,913 | A | 5/1961 | Zdanowich | |
| 2,984,817 | A | 5/1961 | Zeffert | |
| 3,512,121 | A * | 5/1970 | Bergeron | 439/722 |
| 4,133,598 | A | 1/1979 | Kuntzsch | |
| 5,203,724 | A | 4/1993 | Casey | |
| 6,897,584 | B2 | 5/2005 | Doherty et al. | |
| 6,916,213 | B2 | 7/2005 | Nyblin et al. | |
| 7,097,502 | B2 | 8/2006 | Landis et al. | |
| 7,527,523 | B2 | 5/2009 | Yohn et al. | |

OTHER PUBLICATIONS

Blue Sea Systems, 65 Ampere Terminal Blocks, retrieved May 13, 2009 from http://bluesea.com/category/9/36/productline/192, 1 page.

Blue Sea Systems, Power Bar 600 Ampere Common Bus Bars, retrieved May 13, 2009 from http://bluesea.com/category/9/35/productline/189, 1 page.

Electronic Products, Rugged terminal block satisfies international wiring needs, retrieved May 13, 2009 fro http://www2.electronicproducts.com/PrintArticle.aspx?ArticleURL=AUGHL5.AUG1999, 1 page.

Molex, Beau Eurostyle 600V High-Power Terminal Blocks 91,92,92B,95, 96 Series, retrieved May 13, 2009 from http://www.molex.com/molex/products/family?key=eurostyle_terminal_blocks&channel=products&chanName=Family&pageTitle=Introduction, 2 pages.

Blockmaster Blocks, Towers of Power Our High Power Blocks Stand Tall, retrieved May 13, 2009 from http://blockmaster.com/css_site/images/high_power_brochure/blockmaster_high_power_brochure.pdf, 16 pages.

* cited by examiner

*Primary Examiner* — Javaid Nasri
(74) *Attorney, Agent, or Firm* — Janda M. Carter

(57) ABSTRACT

The present disclosure is directed to a terminal assembly member for electrically connecting output leads to external systems and equipment, including a one piece insulating body formed from high-pressure molten plastic/nylon, adapted for mounting to an external portion of a generator housing; one or more conductive inserts over-molded within the one piece insulated body, the conductive inserts having at least one threaded bore for receiving a bolt; and one or more bronze alloy lug structures over-molded within the one piece insulated body, the one or more lug structures having a generally L-shaped geometry and a plurality of bores adapted for attaching terminal ring carriers.

18 Claims, 3 Drawing Sheets

ONE-PIECE TERMINAL BLOCK ASSEMBLY

TECHNICAL FIELD

The present disclosure relates generally to electrical terminal assemblies and, more particularly to a terminal assembly block used to transmit electrical energy between the generators and motors.

BACKGROUND

A wide variety of power terminal assemblies exist for use today, depending upon the environment and application for which they are intended. In some applications, multiple sets of wires within an end product are joined within the power terminal block assembly to external power cords and other types of connectors. Examples of these applications may be found in various environments, such as in manufacturing where equipment is utilized having high power demands, or in aircraft electrical and power systems.

Additionally, many printed circuit boards or PCBs use terminal block connectors that have integral molded metallic conductors. These boards however, do not typically have the high amperage capability as needed in large machine power systems. Generally, these terminal blocks are used to connect generators to motors by acting as robust, distribution attachment points. However, conventional power terminal block assemblies may be difficult and costly to manufacture. Many current terminal blocks involve multi-piece assemblies having numerous individual parts with individual idiosyncrasies. Some of the many components may include an overall terminal assembly with numerous stainless steel inserts, block terminals made of a conductive material, machined stud bores, all requiring expensive and labor intensive taper lock studs, spring clips, and the like. Taper locks are used to prevent the studs from coming loose when disassembling a connector.

One type of terminal block or busbar includes molded in conductors and vertical dividers. U.S. Pat. No. 7,527,523 (the '523 patent) to Yohn et al. teaches such a power terminal having an electrically insulated connector. The terminal insert is incorporated into the connector body and has at least one treaded electrically conductive member engaged with the terminal insert. The conductive member also includes a cap portion.

The cap portion includes a cavity configured to receive a portion of the material making up the connector body. However, this cap is a completely separate piece that must preferably be attached to the connector body by a cover mount via a fastening arrangement (such as screwing or bolting). This extra piece, with its separate mounting and fastening means and requirements creates an undesirable challenge, from both technical assembly and cost standpoints. Further, these types of inserts have often been designed with partitions or dividers having sharp corners, which may introduce stresses or cracking in the molds and unacceptable assemblies, with use over time. Additionally, the cost associated with the tooling required for creating the threaded bores and the increased assembly costs and time required to manufacture, insert, and maintain the taper bore studs may be prohibitive.

The disclosed method is directed to overcoming one or more of the challenges set forth above.

SUMMARY

The present disclosure is directed to a terminal assembly member for electrically connecting output leads to external systems and equipment, having a one piece insulating body formed from high-pressure molten plastic/nylon, adapted for mounting to an external portion of a generator housing; one or more conductive metal inserts over-molded within the one piece insulated body, the inserts having at least one threaded bore for receiving a bolt; and one or more bronze alloy lug structures over-molded within the one piece insulated body, the one or more lug pieces having a generally L-shaped geometry and a plurality of bores adapted for attaching terminal rings.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

Figure 1:
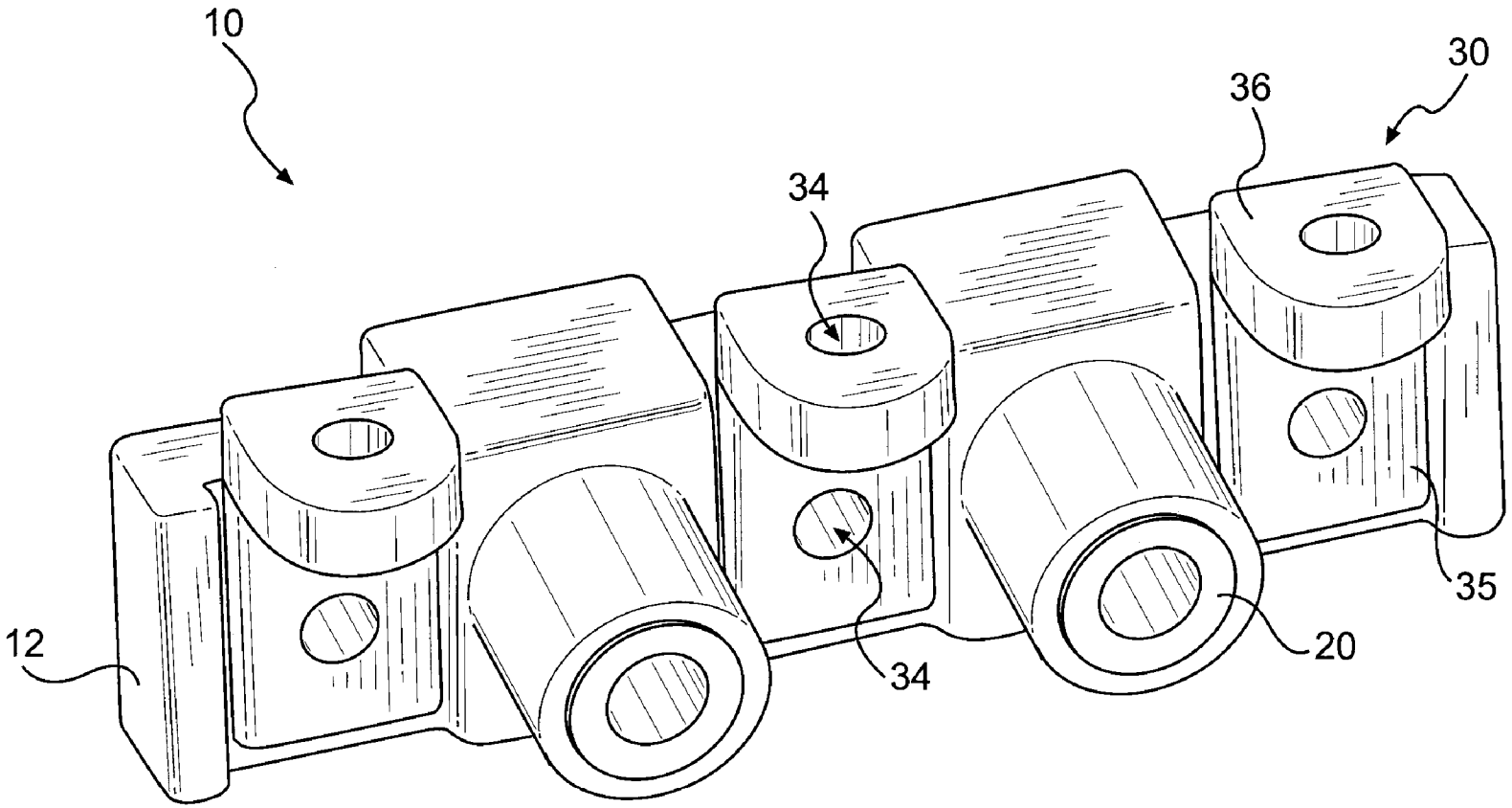
FIG. 1 is a perspective view in accordance with one embodiment of the disclosed terminal block assembly.

FIG. 1 illustrates a terminal block assembly 10, used in such as a generator, motor, or alternator, or electric device. Such devices are typically employed in connection with various machines to generate electric power to convert electrical power to mechanical output. For example, such devices may be employed as a portion of a mobile machine such as, for example, a dozer, an articulated truck, an excavator, or any other mobile machine known in the art, with electric machine technology functioning as the main propulsion unit. It is also contemplated that the terminal block assembly 10 may form a portion of a stationary machine such as a generator set, pump, or similar machines.

The current terminal block assembly 10 may utilize conductive inserts 20 mounted in or molded into the assembly 10. The conductive inserts 20 may be designed to provide mounting flanges 22 along the top and on the face. These flanges 22 may be aligned vertically, horizontally, or any combination given the overall spatial geometry. The conductive inserts 20 are preferably made of steel. Additionally, hex bolts may replace expensive taper lock studs traditionally seen with these assemblies.

An integral part of this novel innovation are alloy based lug structures 30, which are over-molded within the one-piece insulated body 12. The lug structures 30 having a generally L-shaped geometry and a plurality of bores 34 adapted for attaching terminal ring carriers 40. The lugs 30 are generally perpendicularly shaped leg portions 35, 36. Generally, there is a horizontally facing leg portion 35 and a vertically facing leg portion 36. Along the horizontally facing leg portion 35 may be a horizontally protruding segment 38 for capturing an attachment or conductive means (not shown). The protruding segment 38 may extend from a front face or a rear face of the generally horizontally extending leg portion 35. The protruded segment 38 of the lug 30 incorporates a single cast-in anti-rotation flat surface 39 essentially parallel to the generally horizontally facing leg portion 35.

Figure 4:
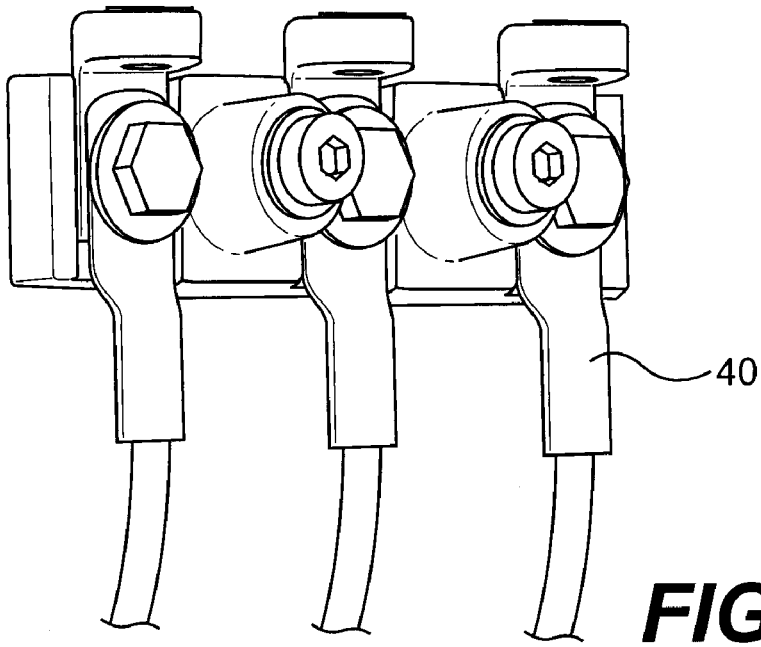
FIG. 4 is a perspective view of the terminal block assembly of FIG. 1 connected to a plurality of terminal rings.

The leg portions 35, 36 may also be at 90-180 degree angles from each other. The leg portions 35, 36 allow for the elimination of elbow connectors (not shown) seen in many prior art assemblies. Elbow connectors may increase stresses on the wires. The leg portions 35, 36 assist with the alignment of the cables or wires (going vertically or horizontally) into the electric boxes or devices. Standard bolts may be used to capture the terminal rings 40, as shown in FIG. 4.

As further shown in FIG. 1, the inserts 20 and the alloy lug structures 30 are preferably over-molded within the terminal block assembly 10. Overmolding onto the steel inserts 20 and the alloy lugs 30 assists in meeting the sufficient creepage allowance, even with a tighter center distance.

Figure 2:
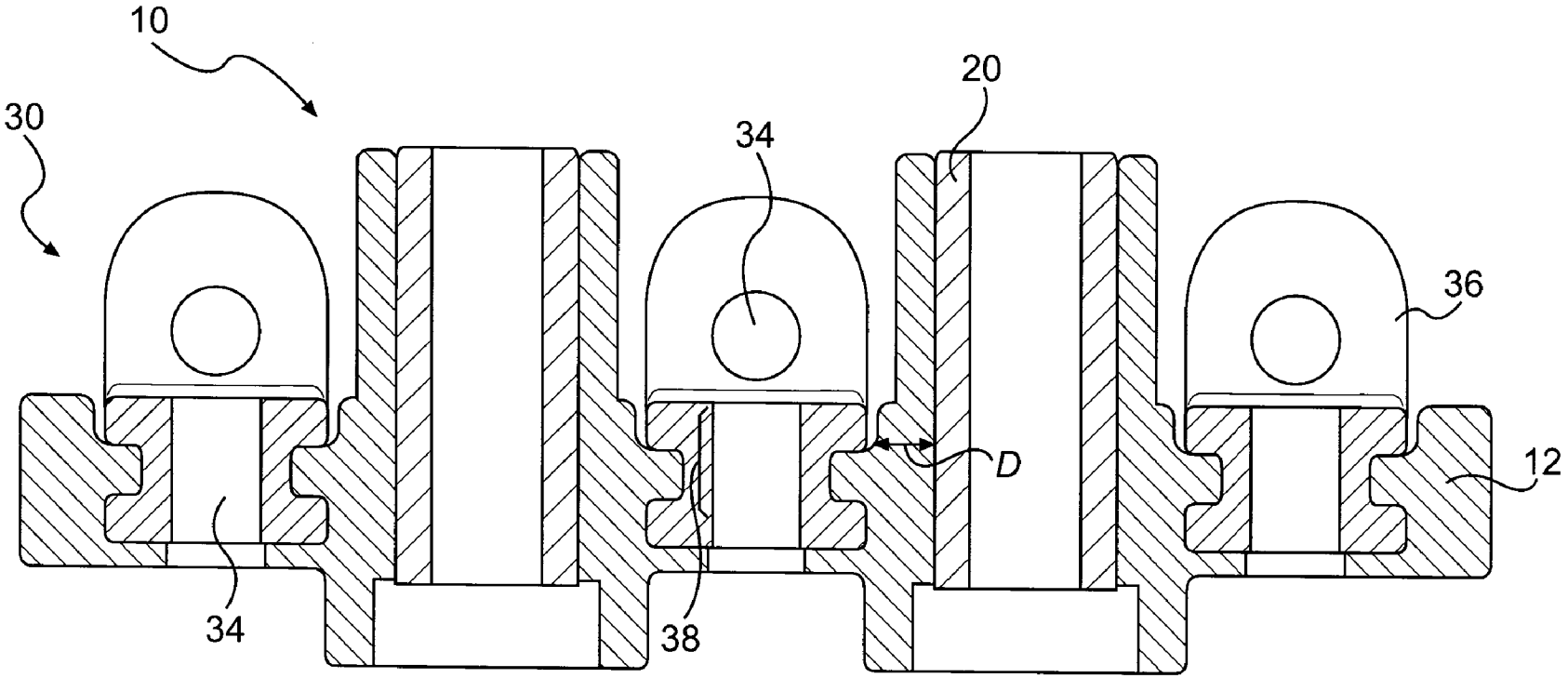
FIG. 2 is an enlarged view of a cross-section of the assembly of FIG. 1.
Figure 3:
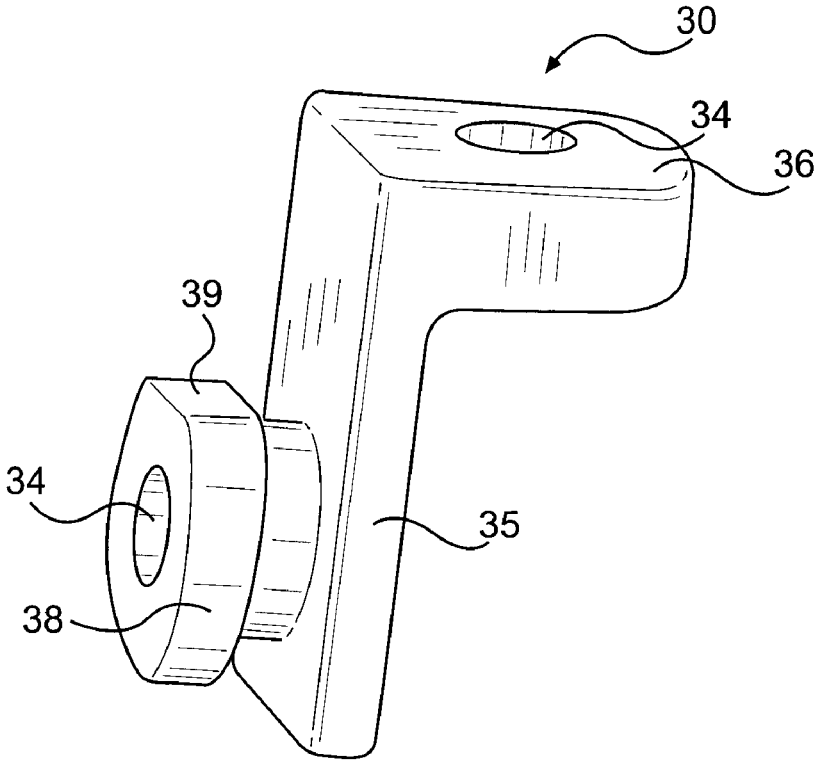
FIG. 3 is a view of a perspective view of an alloy lug structure of the assembly of FIG. 1.

Turning now, in particular, to FIG. 2, the distance D between the inserts 20 and lugs 30 within the one piece insulating body 12 creates sufficient creepage allowance. Creepage is the shortest path between two conductive parts (or between a conductive part and the bounding surface of the equipment) measured along the surface of the insulation. A proper and adequate (sufficient) creepage distance protects against tracking, a process that produces a partially conductive path of localized deterioration on the surface of an insulating material as a result of the electric discharges on or close to an insulation surface. This sufficient distance is known in the art, and varies for the various applications.

The lug segments 30 are preferably formed from a phosphor bronze alloy. The alloy may be made of copper and tin, or copper and aluminum, or any other similarly suited alloy as would be understood by one skilled in the art.

INDUSTRIAL APPLICABILITY

The disclosed terminal assembly finds potential application in any power system where it is desirous to control heat dissipation within a switched reluctance electric machine. The disclosed terminal assembly finds particular applicability in vehicle drive systems. One skilled in the art will recognize that the disclosed terminal block assembly could be utilized in relation to other drive systems that may or may not be associated with a machine or vehicle.

It will be appreciated that the foregoing description provides examples of a novel one-piece integral terminal block design. However, it is contemplated that other implementations of the disclosure may differ in detail from the foregoing examples, as would occur to those skilled in the art. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely, unless otherwise indicated.

Recitation of ranges of values or dimensions herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. Accordingly, this disclosure includes all modifications and equivalents of subject matter recited in the claims appended hereto as permitted by applicable law. Moreover, any combination of the above-described elements in all possible variations thereof is encompassed by the disclosure unless otherwise indicated herein or otherwise clearly contradicted by context.

The terminal block designs of the present disclosure may be used in connection with various power modules, propulsion modules and power electronics to provide the energy requirements between generators and motors, with fewer separate components, and at a potentially significantly lower cost than conventional designs. Moreover, the fact that there are no taper lock studs may result in improved performance and life of the device by preventing stresses which lead to cracking that may occur due to oft seen sharp corners from dividers or partitions.

It should be recognized that other aspects, objects, advantages, or applications of the present disclosure might fall within the scope of the drawings, disclosure and the appended claims.

What is claimed is:

1. A terminal assembly member for electrically connecting output leads from a power generation unit to external systems and equipment, the terminal assembly member comprising:

a one piece insulated body formed from high-pressure molten plastic, adapted for mounting to an external portion of a housing of the power generation unit, one or more conductive inserts over-molded within the insulated body, the one or more conductive inserts having at least one threaded bore for receiving a bolt; and one or more bronze alloy lug structures over-molded within the insulated body, the one or more lug structures having first and second leg portions forming a generally L-shaped geometry, each of the first and second leg portions including a bore adapted for attaching a respective terminal ring, the bores of the respective first and second leg portions being positioned at an angle from each other.

2. The terminal assembly member of claim 1, wherein the one or more conductive inserts is formed by investment casting.

3. The terminal assembly member of claim 1, wherein the one or more conductive inserts is composed of metal.

4. The terminal assembly member of claim 1, wherein a distance between the one or more conductive inserts and the one or more alloy lug structures within the one piece insulated body creates sufficient creepage allowance.

5. The terminal assembly member of claim 1, wherein the one or more alloy lug structures is generally perpendicularly shaped with one of the first and second leg portions being a generally horizontally facing leg portion, the other one of the first and second leg portions being a generally vertically facing leg portion, and a horizontally protruding segment aligned with one of the plurality of bores of the first and second leg portions.

6. The terminal assembly member of claim 5, wherein the protruding segment of the one or more lug structures incorporates a single cast-in anti-rotation flat surface parallel to the generally horizontally facing leg portion.

7. The terminal assembly member of claim 1, wherein the one or more bronze alloy lug structures is made of phosphor bronze.

8. The terminal assembly member of claim 1, wherein the one or more bronze alloy lug structures is made of copper and tin.

9. The terminal assembly member of claim 1, wherein the one or more bronze alloy lug structures is made of copper and aluminum.

10. The terminal assembly member of claim 1, wherein the bores of the first and second leg portions are threaded for receiving respective bolts.

11. A terminal assembly member for electrically connecting output leads from a power generation unit to an external system and equipment, the terminal assembly member comprising:

an insulated body configured to mount to a housing;

a pair of conductive inserts disposed within the insulated body, each conductive insert having a bore configured to connect to a respective first fastening device; and at least one lug structure disposed within the insulated body between the pair of conductive inserts, the at least one lug structure comprising a first leg portion and a second leg portion positioned at an angle with respect to the first leg portion, the first and second leg portions each including a bore configured to connect to a respective second fastening device.

12. The terminal assembly member of claim 11, wherein the first and second fastening devices are bolts.

13. The terminal assembly member of claim 11, wherein:

the insulated body is one piece; and the pair of conductive inserts and the at least one lug structure are over-molded within the insulated body.

14. The terminal assembly member of claim 11, wherein:

each conductive insert further includes a first end, a second end, and an outer surface extending between the first end and the second end; and substantially the entire outer surface of each conductive insert is disposed within the insulated body.

15. A terminal assembly member for electrically connecting output leads from a power generation unit to an external system and equipment, the terminal assembly member comprising:

an insulated body configured to mount to a housing;

at least one conductive insert disposed within the insulated body, the at least one conductive insert having at least one bore configured to connect to a first fastening device, the at least one conductive insert further including a first end, a second end, and an outer surface extending between the first end and the second end, substantially the entire outer surface being disposed within the insulated body; and at least one lug structure disposed within the insulated body, the at least one lug structure comprising a first leg portion and a second leg portion positioned at an angle with respect to the first leg portion, the first and second leg portions each including a bore configured to connect to a respective second fastening device.

16. The terminal assembly member of claim 15, wherein:

the at least one bore of the at least one conductive insert includes a first axis;

the bore of the first leg portion includes a second axis that is generally parallel to the first axis;

the bore of the second leg portion includes a third axis; and the second leg portion is angled with respect to the first leg portion such that the third axis is angled with respect to the second axis.

17. The terminal assembly member of claim 15, wherein the first and second fastening devices are bolts.

18. The terminal assembly member of claim 15, wherein:

the insulated body is one piece; and the at least one conductive insert and the at least one lug structure are over-molded within the insulated body.

* * * * *